US006186746B1

(12) United States Patent
Bodzak et al.

(10) Patent No.: US 6,186,746 B1
(45) Date of Patent: Feb. 13, 2001

(54) FUEL DELIVERY PUMP FOR A FUEL INJECTION PUMP FOR INTERNAL COMBUSTION ENGINES

(75) Inventors: Stanislaw Bodzak, Elsbethen; Hanspeter Mayer, Hallein, both of (AT)

(73) Assignee: Robert Bosch GmbH, Stuttgart (DE)

( * ) Notice: Under 35 U.S.C. 154(b), the term of this patent shall be extended for 0 days.

(21) Appl. No.: 09/029,493

(22) PCT Filed: Feb. 6, 1997

(86) PCT No.: PCT/DE97/00221

§ 371 Date: Jul. 27, 1998

§ 102(e) Date: Jul. 27, 1998

(87) PCT Pub. No.: WO97/49916

PCT Pub. Date: Dec. 31, 1997

(30) Foreign Application Priority Data

Jun. 26, 1996 (DE) ..... 196 25 567

(51) Int. Cl.[7] ..... F04F 5/44
(52) U.S. Cl. ..... 417/199.2; 417/435
(58) Field of Search ..... 417/199.1, 199.2, 417/435, 440, 300

(56) References Cited

U.S. PATENT DOCUMENTS 2,442,361 * 6/1948 Hulman ..... 137/512.3
4,596,519 * 6/1986 Tuckey ..... 418/15
5,039,284 * 8/1991 Talaski ..... 417/366
5,263,459 * 11/1993 Talaski ..... 123/516

* cited by examiner

*Primary Examiner*—Henry Bennett
*Assistant Examiner*—Melvin Jones
(74) *Attorney, Agent, or Firm*—Ronald E. Greigg; Edwin E. Greigg

(57) ABSTRACT

A fuel delivery pump for a fuel injection pump for internal combustion engines, including a pair of gears that mesh with each other and are driven to rotate in a pump chamber. The pair of gears deliver fuel from an intake chamber connected to a storage tank, along a supply conduit that is formed between the end face of the gears and the circumference wall of the pump chamber, into a pressure chamber connected to the fuel injection pump. A conduit is provided that connects the intake chamber to the pressure chamber. The conduit can be connected to a ventilation device, and that upstream and downstream of the ventilation device, a pressure valve is provided for a directed fuel flow in the conduit.

17 Claims, 3 Drawing Sheets

FUEL DELIVERY PUMP FOR A FUEL INJECTION PUMP FOR INTERNAL COMBUSTION ENGINES

PRIOR ART

The invention is based on a fuel delivery pump for a fuel injection pump for internal combustion engines.

In fuel delivery pumps of this kind, a pair of gears that mesh with each other and are driven to rotate in a pump chamber is provided, which delivers fuel from an intake chamber connected to a storage tank, along a supply conduit that is formed between the end face of the gears and the circumference wall of the pump chamber into a pressure chamber connected to the fuel injection pump. One gear is fastened to a shaft and can be driven to rotate with a drive element that engages the axle. The drive element is provided outside the housing of the pump chamber and transmits the rotational motion to a second gear that meshes with the first gear and is disposed on a second axle supported in the housing.

For a first operation of the internal combustion engine or when a fuel delivery pump is replaced, as well as when the fuel delivery pump is dry, a ventilation of the line system as well as the pump chamber can be necessary so that a rapid pressure increase and fuel delivery can be achieved immediately after the internal combustion engine is started.

ADVANTAGES OF THE INVENTION

The fuel delivery pump according to the invention, for a fuel injection pump for internal combustion engines has the advantage that a ventilation device which can be inserted into a conduit that connects the intake chamber with the pressure chamber permits a ventilation of the fuel delivery pump. To this end, at least one pressure valve is respectively provided upstream and downstream of the ventilation device, which valves are disposed so that a directed flow of an air volume generated by the ventilation device is forced into a directed flow so that a ventilation of the fuel delivery pump can be provided.

According to a preferable embodiment of the invention, the conduit that connects the intake chamber to the pressure chamber is disposed in a housing cover of the fuel delivery pump and the ventilation device can be inserted into this conduit. As a result, a space saving arrangement can be achieved. A pressure valve can advantageously be disposed in the housing cover, respectively upstream and downstream of the ventilation device. This can be respectively disposed in a valve chamber of the conduit in such a way that when the ventilation device is actuated, the pressure valve disposed upstream of the ventilation device closes and the pressure valve disposed downstream of the ventilation device opens toward the pressure chamber. As a result, a defined and directed flow can be achieved in order to ventilate the pump chamber.

According to another advantageous embodiment of the invention, the pressure valve disposed upstream of the ventilation device is provided in a fuel line that leads from a storage tank to the fuel delivery pump. As a result, a directed flow in the direction of the fuel injection pump can in turn be produced since the pressure valve disposed in the fuel line closes upstream in relation to the storage tank.

According to another advantageous embodiment of the invention, the ventilation device can be inserted into an opening of the housing. This ventilation device can be inserted permanently or when needed. When the ventilation device is not inserted, the conduit can advantageously be closed by means of a closing valve or closing element provided in the opening.

Other advantages and advantageous embodiments of the subject of the invention ensue from the description the drawings, and the claims.

BRIEF DESCRIPTION OF THE DRAWINGS

The drawings show exemplary embodiments of the fuel delivery pump according to the invention, which are explained in detail in the description below.

DESCRIPTION OF THE EXEMPLARY EMBODIMENTS

Figure 1:
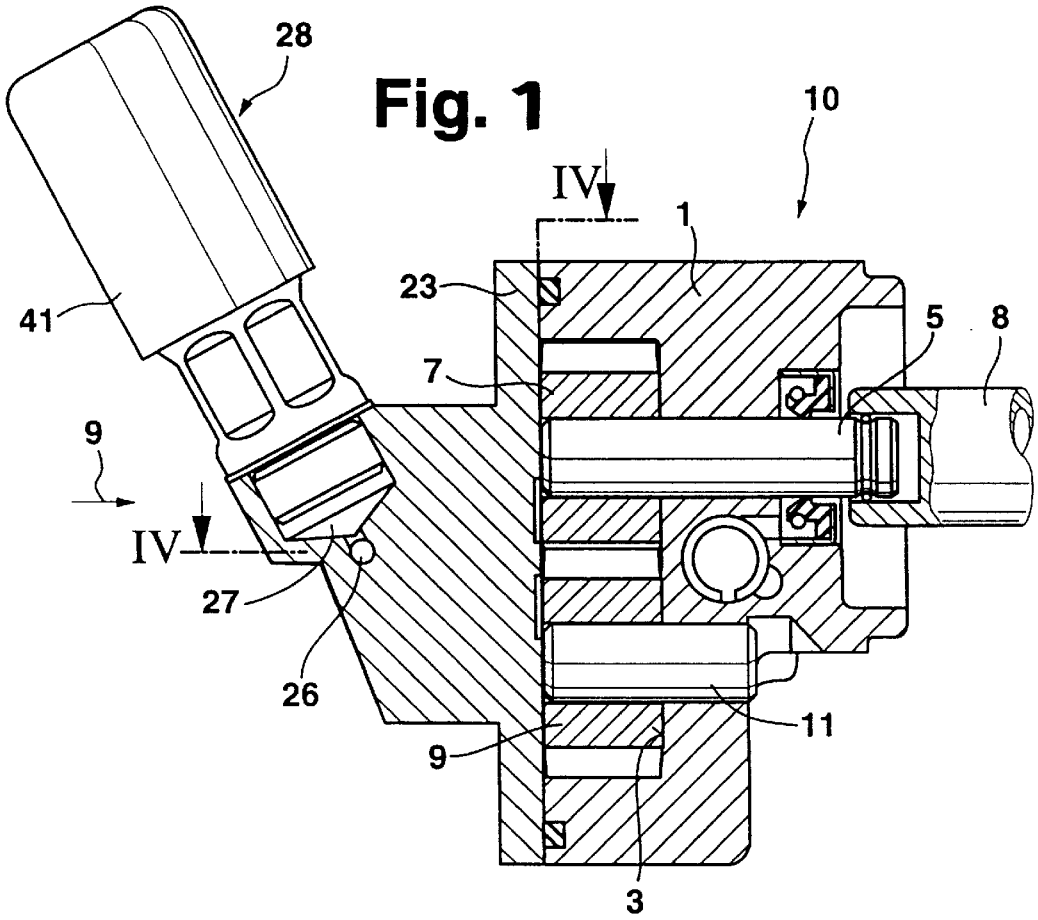
FIG. 1 is a longitudinal section through the fuel delivery pump along line I—I of FIG. 2.
Figure 2:
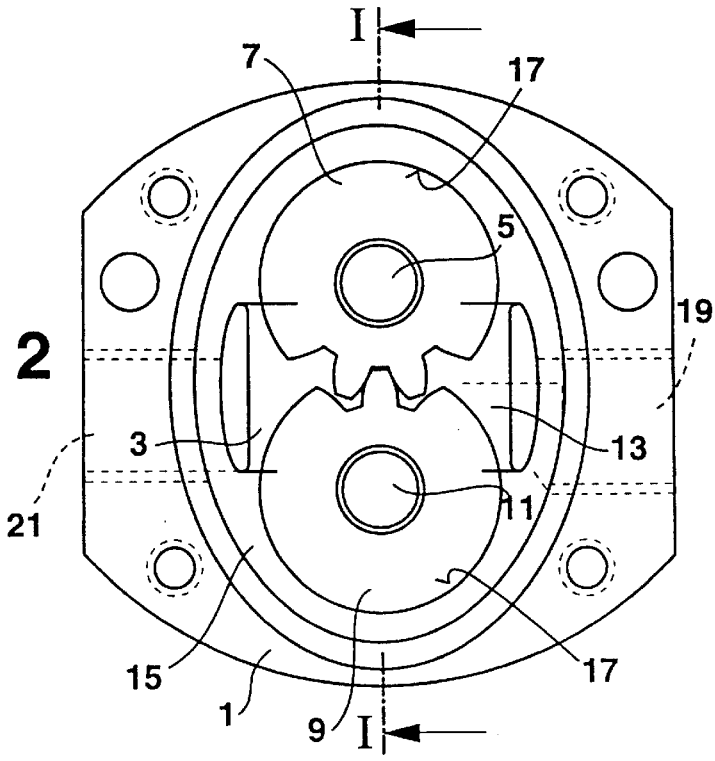
FIG. 2 is a top view of the fuel delivery pump shown in FIG. 1, with a cover taken off.
Figure 3:
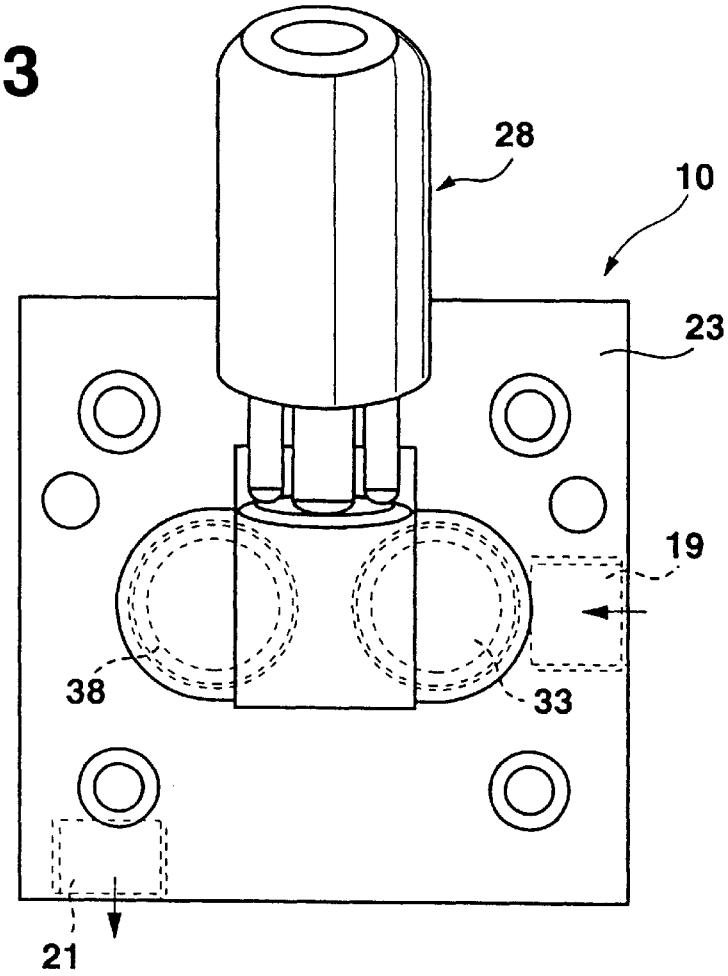
FIG. 3 is a side view of the fuel delivery pump represented in FIG. 1, in accordance with the arrow direction 9.

FIGS. 1 to 4 represent different views of a fuel delivery pump 10, which is inserted in a supply line, not shown, from a storage tank to a fuel injection pump for internal combustion engines. In its housing 1, the delivery pump 10 has a pump chamber 3 in which a rotary driven pair of gears is disposed that mesh with each other. A first gear 7 fastened to a shaft 5 is driven to rotate by means of a drive element 8 and transmits this rotary motion to a second gear 9 that meshes with the first gear 7 and is disposed on an axle 11 supported in the housing. By means of their tooth engagement, the gears 7, 9 divide the pump chamber 3 into two parts of which a first part constitutes an intake chamber 13 and a second part constitutes a pressure chamber 15. The intake chamber 13 communicates with the pressure chamber 15 via a supply conduit 17 formed between the tooth grooves on the end faces of the first gear 7 and the second gear 9, and the circumference wall of the pump chamber 3. In addition, the intake chamber 13 and the pressure chamber 15 each have a connection opening in a wall of the pump housing 1, via which the intake chamber 13 communicates with an intake line, not shown, from the storage tank and via which the pressure chamber 15 communicates with a supply line, likewise not shown, to the intake chamber of the fuel injection pump. The connection opening in the intake chamber 13 forms an inlet opening 19 and the connection opening in the pressure chamber 15 forms an outlet opening 21. The pump chamber 3 is sealed on its one end face in the axial direction of the shaft 5 and the axle 11 by a housing cover 23, which has been removed in the depiction in FIG. 2 and thus permits a view of the pump interior.

A conduit 26, which connects the intake chamber 13 to the pressure chamber 15, is provided in the housing cover 23 and has an opening 27 into which a ventilation device 28 can be inserted. Upstream of the opening 27, a bore section 31 with a valve chamber 32 is provided in which a pressure valve 33 is disposed. Downstream of the opening 27, a second bore section 36 is provided, which has a pressure valve 38 disposed in a valve chamber 37. The pressure valves 33 and 38 are advantageously embodied as check valves and are disposed so that when the conduit 26 is put under pressure by the ventilation device 28, the pressure valve 33 closes in relation to the intake chamber 13 and the pressure valve 38 opens toward the pressure chamber 15. As a result, a directed flow can be produced, which will be described in more detail below.

In the exemplary embodiment, the ventilation device 28 is embodied as a hand pump. This has a grasping cap 41, whose actuation can supply a particular air volume to the conduit 26. The ventilation device is advantageously embodied as temperature and vibration resistant and can be inserted into the opening 27 as needed or can be disposed in it permanently. Alternatively, a motor driven ventilation device can be inserted into and disposed in the opening 27. A closing valve is advantageously provided in the opening 27 or a closing cap can be inserted so that the conduit 26 is closed when the ventilation device 28 is not inserted.

Figure 4:
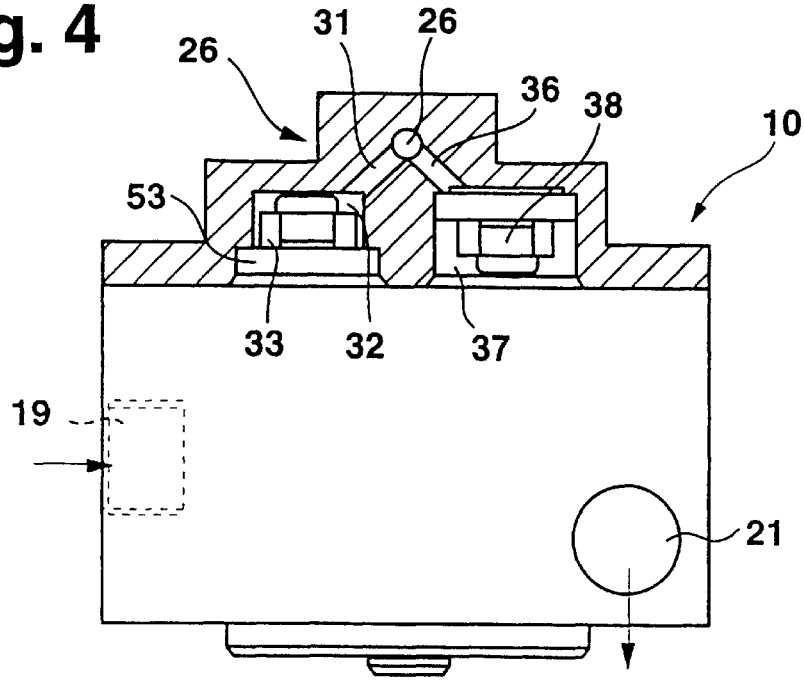
FIG. 4 is a longitudinal section through a housing cover of the fuel delivery pump, along the line IV—IV from FIG. 1.
Figure 5:
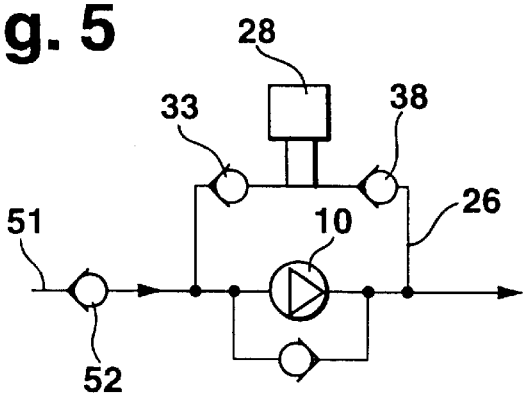
FIG. 5 is a schematic diagram of a circuit arrangement according to the fuel delivery pump in FIGS. 1–4.

FIG. 5 depicts a circuit diagram of the exemplary embodiment shown in FIGS. 1 to 4. A check valve 52 is disposed via a fuel line 51 leading from the supply tank to the fuel delivery pump, which prevents fuel from being forced back into the storage tank. The fuel is delivered in the arrow direction to the fuel delivery pump, which delivers fuel to the fuel injection pump in the arrow direction from left to right. The conduit 26 with the ventilation device 28 is disposed parallel to the fuel delivery pump 10. The pressure valve 33 and 38 is disposed upstream and downstream of the ventilation device 28.

When the ventilation device 28 is actuated, a particular air volume 53 is displaced according to FIG. 4 and due to the disposition of the valves 33, 38, is forced into a directed flow in the direction of the fuel injection pump. Through the disposition of the pressure valves 33, 38 upstream and downstream, an inner circuit between the delivery pump 10 and the conduit 26 can be prevented.

Figure 6:
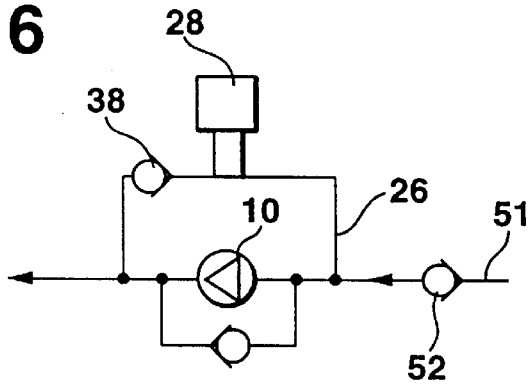
FIG. 6 is a schematic diagram of a circuit arrangement alternative to FIG. 5.

FIG. 6 depicts a circuit diagram of an embodiment alternative to FIG. 5. The pressure valve 33 is disposed in the fuel line 51. Furthermore, the pressure valve 38 is provided downstream of the ventilation device 28 so that in turn, a particular air volume 53 can be displaced. Disposing the pressure valve 33 in the fuel line 51 can prevent the displaced air volume from being forced back into the fuel line 51.

Figure 7:
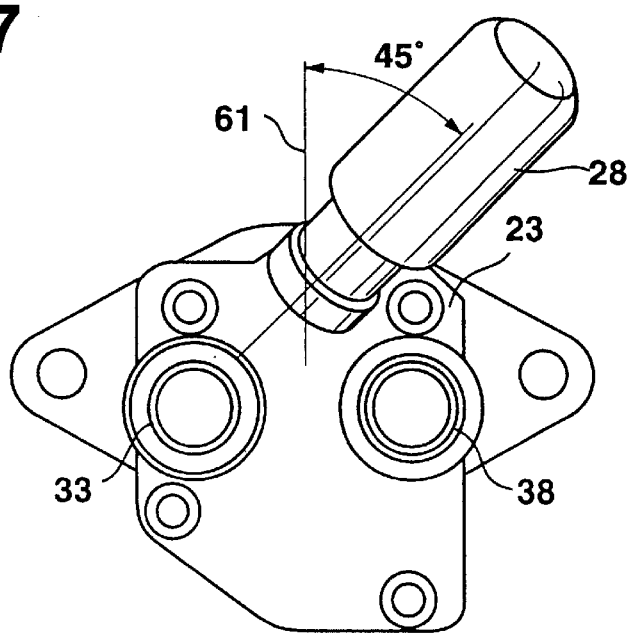
FIG. 7 shows an alternative embodiment of a ventilation device disposed on the housing cover.

FIG. 7 shows an embodiment alternative to the one in FIGS. 1 to 4. The ventilation device 28 is inclined, for example at an angle of 45° in relation to the axis 61. The angular disposition of the ventilation device 28 in relation to the housing cover 23 can also be provided in a more suitable angular position as a function of the available space. As a result, a favorable accessibility can be achieved for the insertion of the ventilation device 28 into the opening 27.

Furthermore, the operability of and accessibility to the ventilation device 28 can be facilitated.

The foregoing relates to preferred exemplary embodiment of the invention, it being understood that other variants and embodiments thereof are possible within the spirit and scope of the invention, the latter being defined by the appended claims.

We claim:

1. A fuel delivery pump in combination with a fuel injection pump for internal combustion engines, comprising a pair of gears (7, 9) that mesh with each other and are driven to rotate in a pump chamber (3), said gears (7, 9) deliver fuel from an intake chamber (13) connected to a storage tank, along a supply conduit (17) that is formed between an end face of the gears (7, 9) and a circumference wall of the pump chamber (3), into a pressure chamber (15) connected to the fuel injection pump, a conduit (26) is provided that connects the intake chamber (13) with the pressure chamber (15), said conduit correctable connected to a ventilation device (28), and that upstream and downstream of the ventilation device (28), a pressure valve (33, 38) is provided for a directed flow in the conduit (26).

2. The fuel delivery pump according to claim 1, in which the pressure valve (33) located upstream of the ventilation device (28) is disposed in a valve chamber (32) of a bore section (31) of the conduit (26) and the valve (38) located downstream of the ventilation device (28) can be disposed in a valve chamber (37) of the bore section (36) of the conduit (26).

3. The fuel delivery pump according to claim 2, in which the conduit (26) is provided in a housing cover (23).

4. The fuel delivery pump according to claim 3, in which the pressure valve (33) located upstream of the ventilation device (28) closes upstream and that the pressure valve (38) located downstream of the ventilation device (28) is opened in the flow direction toward the pressure chamber (15).

5. The fuel delivery pump according to claim 3, which an opening (27) is provided in the housing cover (23) to contain the ventilation device (28), said opening has a closing valve that closes the opening (27) when the ventilation opening (28) is not inserted in the opening.

6. The fuel delivery pump according to claim 2, in which the pressure valve (33) located upstream of the ventilation device (28) closes upstream and that the pressure valve (38) located downstream of the ventilation device (28) is opened in the flow direction toward the pressure chamber (15).

7. The fuel delivery pump according to claim 1, in which the valve (38) provided downstream of the ventilation device is disposed in a valve chamber (37) of a bore section (36) in the conduit (26) and that the valve (33) provided upstream of the ventilation device (28) can be disposed in a fuel line (51) leading from the storage tank to the fuel delivery pump.

8. The fuel delivery pump according to claim 7, in which the conduit (26) is provided in a housing cover (23).

9. The fuel delivery pump according to claim 8, in which the pressure valve (33) located upstream of the ventilation device (28) closes upstream and that the pressure valve (38) located downstream of the ventilation device (28) is opened in the flow direction toward the pressure chamber (15).

10. The fuel delivery pump according to claim 8, which an opening (27) is provided in the housing cover (23) to contain the ventilation device (28), said opening has a closing valve that closes the opening (27) when the ventilation opening (28) is not inserted in the opening.

11. The fuel delivery pump according to claim 7, in which the pressure valve (33) located upstream of the ventilation device (28) closes upstream and that the pressure valve (38) located downstream of the ventilation device (28) is opened in the flow direction toward the pressure chamber (15).

12. The fuel delivery pump according to claim 1, in which the conduit (26) is provided in a housing cover (23).

13. The fuel delivery pump according to claim 12, in which an opening (27) is provided in the housing cover (23) to contain the ventilation device (28), said opening has a closing valve that closes the opening (27) when the ventilation opening (28) is not inserted in the opening.

14. The fuel delivery pump according to claim 12, in which the pressure valve (33) located upstream of the ventilation device (28) closes upstream and that the pressure valve (38) located downstream of the ventilation device (28) is opened in the flow direction toward the pressure chamber (15).

15. The fuel delivery pump according to claim 1, in which the pressure valve (33) located upstream of the ventilation device (28) closes upstream and that the pressure valve (38) located downstream of the ventilation device (28) is opened in the flow direction toward the pressure chamber (15).

16. The fuel delivery pump according to claim 1, in which the ventilation device (28) is a hand pump.

17. The fuel delivery pump according to claim 1, in which the conduit (26) is provided in the housing (1).

* * * * *